United States Patent [19]

Hendrickson

[11] Patent Number: 4,874,017

[45] Date of Patent: Oct. 17, 1989

[54] SCREEN AND FLOW REGULATOR ASSEMBLY

[76] Inventor: Donald W. Hendrickson, P.O. Box 999, Corona, Calif. 91718

[21] Appl. No.: 160,727

[22] Filed: Mar. 10, 1988

Related U.S. Application Data

[63] Continuation-in-part of Ser. No. 27,440, Mar. 18, 1987, Pat. No. 4,830,057.

[51] Int. Cl.[4] ..... F15D 1/02

[52] U.S. Cl. ..... 138/45; 138/41; 239/533.13

[58] Field of Search ..... 138/44, 45, 46, 41; 239/533.13, 533.14, 547, 596, 542, DIG. 12

[56] References Cited

U.S. PATENT DOCUMENTS

| | | |
|---|---|---|
| 815,806 | 3/1906 | Francis . |
| 3,109,459 | 11/1963 | Lee, II et al. . |
| 3,724,502 | 4/1973 | Hayner et al. . |
| 4,091,996 | 5/1978 | Nelson . |
| 4,105,050 | 8/1978 | Hendrickson et al. . |
| 4,161,965 | 7/1979 | Merritt . |
| 4,248,270 | 2/1981 | Ostrowski . |
| 4,492,339 | 1/1985 | Kreitzberg . |
| 4,562,960 | 1/1986 | Marty et al. . |
| 4,592,390 | 6/1986 | Boyd . |
| 4,609,014 | 9/1986 | Jurjevic et al. . |

FOREIGN PATENT DOCUMENTS

| | | |
|---|---|---|
| 154109 | 7/1932 | Switzerland . |

*Primary Examiner*—James E. Bryant, III

*Attorney, Agent, or Firm*—Knobbe, Martens, Olson & Bear

[57] ABSTRACT

A fluid flow regulator assembly which is adapted to be held by a pair of fittings within the mouth of a fluid flow channel, comprising a flow regulator housing, a regulator within the housing and a cap for sealing the regulator in the housing.

3 Claims, 2 Drawing Sheets

Fig 1
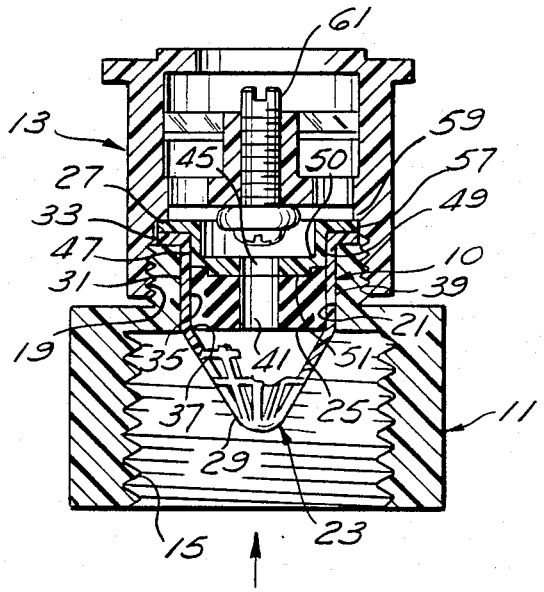
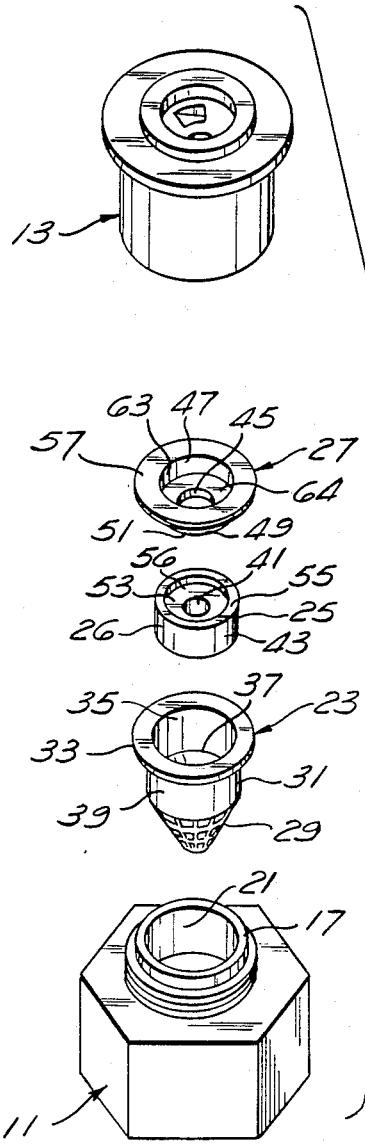
Fig. 2

Fig. 3
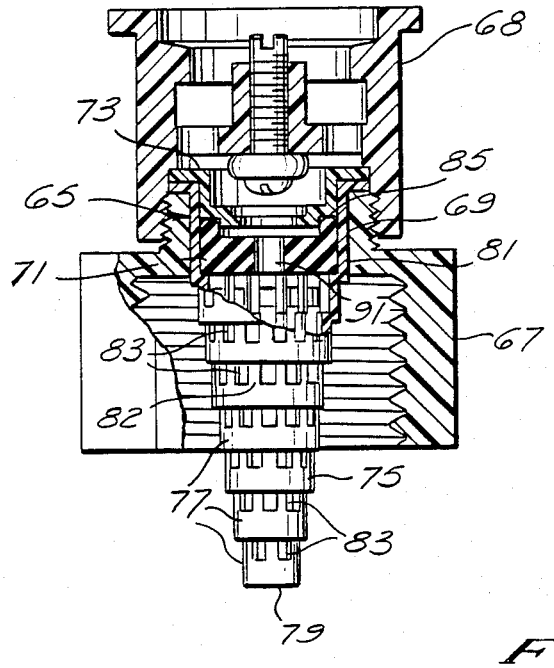
Fig. 4
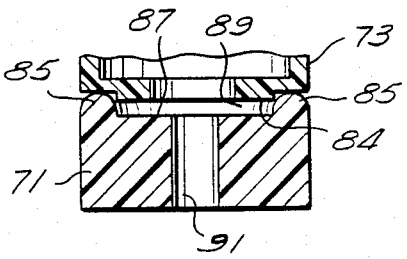
Fig. 5
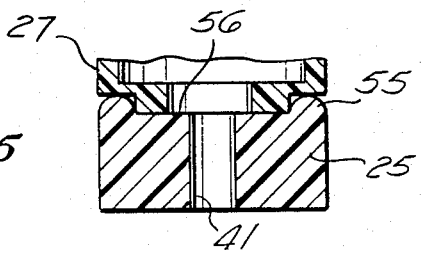
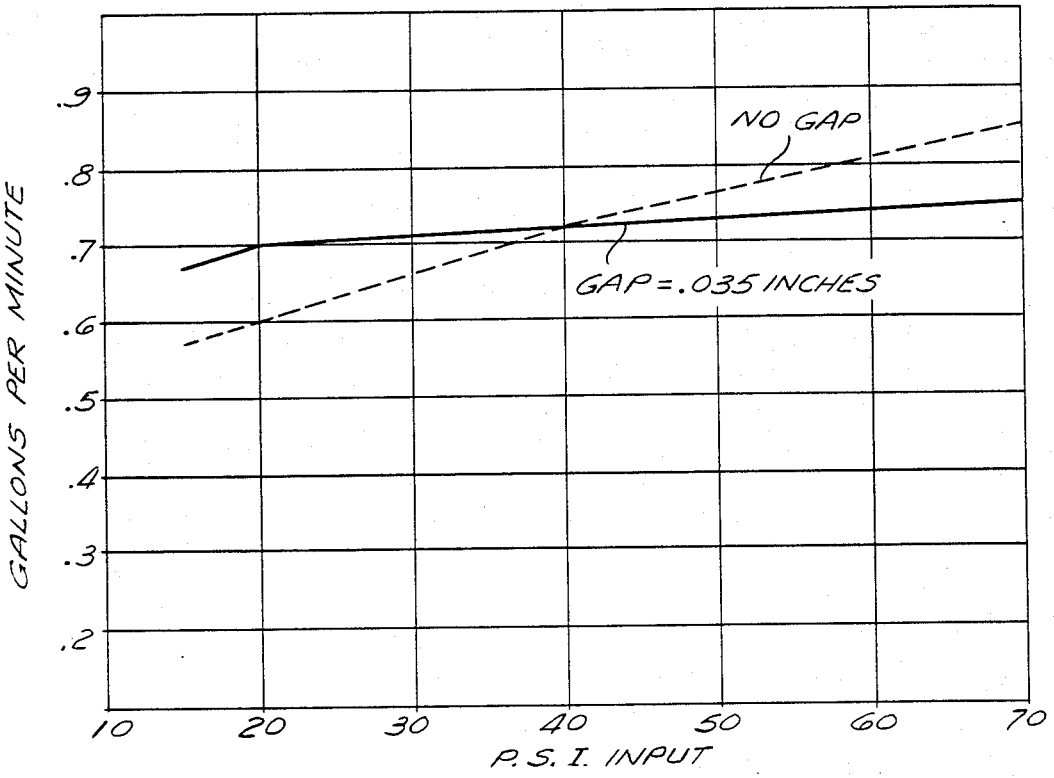
Fig. 6

SCREEN AND FLOW REGULATOR ASSEMBLY

RELATED APPLICATIONS

This is a continuation-in-part of parent application, Ser. No. 027,440, filed Mar. 18, 1987, now U.S. Pat. No. 4,830,507 inventor Donald W. Hendrickson, entitled "Screen and Flow Regulator Assembly."

BACKGROUND OF THE INVENTION

Numerous situations exist where fluid is piped under pressure to a number of final delivery points in which the distribution system is primarily concerned with the distribution of fluid over a given area. Typical situations for this are agricultural sprinkler irrigation systems and home garden sprinkler systems.

In many systems, maintenance of a desired level of fluid flow to certain areas within the system requires a certain minimum pressure at the system supply valve. For example, a given source pressure may be necessary to pump water to sprinklers located at the crest of a hill. Such requirements prevent the final volume rate of flow of fluid in such a system from being lowered by merely adjusting the system supply valve.

Since these systems are typically very large, however, substantial fluid savings can generally be obtained if only the required amount of fluid is discharged at each final delivery point, e.g., each sprinkler head. In order to limit the volumetric delivery rate at each final delivery point, flow restrictors such as elastomeric flow restrictors, are used to obtain a relatively constant fluid volumetric delivery rate over a relatively broad range of initial input delivery pressures. As described in U.S. Pat. Nos. 4,150,050 and 4,609,014, the relatively constant volumetric delivery rate results from the elastomeric flow restrictors changing in shape in response to the input pressure of the fluid against the restrictors. Many existing systems, however, do not include such restrictors and, therefore, the restrictors need to be added to the systems. Since the restrictors must be installed at each final delivery point, it is only practical to install such restrictors if the installation procedure can be quickly and easily performed, and if the restrictors themselves are inexpensive.

Even where the original delivery system incorporates flow restrictors, it may later be found that too large or too small a volume of fluid is being delivered to one area of the system. It is then desirable to be able to change the fluid restrictors utilized at the final delivery points in that area of the system to increase or decrease volume of fluid delivered to that area, without affecting the volume of water delivered to other areas within the system. Likewise, even in properly running systems, it is sometimes desirable to change the volume of fluid delivered throughout the system, either due to a change in the level of seasonal precipitation or a change in the delivery target, e.g., a change of crops.

Since such a restrictor is needed in the field of irrigation, it is desirable that the restrictor be able to be utilized in connection with a wide variety of sprinkler heads. Although sprinkler heads come in a range of shapes and sizes, many are provided with a screen seated within the mouth of the fluid flow channel formed by the sprinkler head fitting to which the sprinkler head is attached. To permit these screens to be used interchangeably in a variety of systems, the mouths of most sprinkler head fittings are of a standard size.

What is needed is a fluid flow regulator which is simple, inexpensive, easy to install and replace, and is adapted to function with a wide variety of existing sprinkler systems.

SUMMARY OF THE INVENTION

A screened fluid flow regulator assembly is adapted to be held by a pair of fittings within a fluid flow channel. The assembly includes a flow restrictor housing and a cap for capturing a flow restrictor or regulator in the housing.

The flow restrictor housing includes an interior wall partially forming a chamber into which the flow restrictor is removably insertable. The housing further includes an outwardly extending flange clampable between said pair of fittings to hold the housing at the mouth of the fluid flow channel. The assembly's housing is preferably molded as a single unit.

Advantageously, the cap further comprises an outwardly extending flange which is clampable between the pair of fittings and an interior surface which forms a clearance cavity downstream from the chamber.

Preferably, the cap also includes a projection adapted to mate with a cavity on a flow restrictor to align the restrictor in the chamber. The assembly can additionally be provided with a flow restrictor or regulator. The flow restrictor and the cap desirably cooperate to form a gap which permits the restrictor to flex in response to the input pressure of fluid against the restrictor to provide a relatively constant flow.

DESCRIPTION OF THE DRAWINGS

FIG. 1 is a cross-sectional view of the assembly of the invention in a fitting with a sprinkler head attached;

FIG. 2 is an exploded perspective view of the components of FIG. 1;

FIG. 3 is a cross-sectional view of an alternative embodiment of the assembly of the invention in a fitting with a sprinkler head attached;

FIG. 4 is an enlarged cross-sectional view illustrating the mating cap and flow resistor of the assembly of FIG. 3;

FIG. 5 is an enlarged cross-sectional view illustrating the mating cap and flow resistor of the assembly of FIG. 1; and FIG. 6 is a graph comparing fluid flow through the assembly of FIGS. 1 and 3 at different input pressures.

DETAILED DESCRIPTION OF THE INVENTION

FIG. 1 shows a flow regulator assembly 10 of the invention inserted for use in a fitting 11 connected to a typical lawn sprinkler head, or second fitting 13. The fitting and sprinkler head are shown for purposes of illustration only, as the assembly is readily adapted to be held within the mouth or other location of any one of a variety of fluid flow channels. The fitting 11 may be provided with threads 15 for attachment to fluid flow pipes, or may be otherwise adapted to insert in a fluid distribution system.

The fitting 11 includes a raised cylindrical portion 17 which is threaded to engage a set of mating threads 19 of the sprinkler head 13. An interior cylindrical surface 21 within the raised cylindrical portion 17 forms the mouth of the fluid flow channel of the fitting 11. It should be understood throughout that fluid will flow from the bottom to the top in all discussions of the drawings, i.e., in the direction of the arrow.

The screened fluid flow regulator assembly includes a flow restrictor housing 23, a flow restrictor 25 and a cap 27. The flow restrictor housing 23 includes a conical screen 29, a cylindrical body 31 downstream from the screen 29, and an outwardly extending flange 33 downstream from the body 31. Preferably, the housing 23 is integrally molded as a single unit. A cylindrical interior wall 35 within the cylindrical body 31 partially forms a chamber into which the flow restrictor 25 can be inserted. The junction between the interior wall 35 and the conical screen 29 forms an annular retaining shoulder 37 which limits the axial movement of the flow restrictor 25 within the chamber.

It is also contemplated that the invention may be used in connection with a cylindrical screen. In such an instance, the cylindrical screen will either have a smaller internal diameter than that of the interior wall of the cylindrical body so as to form an annular retaining shoulder, or tabs or other means will be used to form the shoulder in order to limit the axial movement of the restrictor in the housing.

The cylindrical body 31 has a cylindrical exterior surface 39 which conforms to the interior cylindrical surface 21 of the fitting 11, and preferably forms a fluid-tight seal therewith when the housing 23 is fully inserted within the mouth of the fluid flow channel. In operation, the annular flange 33 of the housing abuts the end of the raised cylindrical portion 17 of the fitting 11 and prevents the housing 23 from slipping through the mouth of the fluid flow channel.

The flow restrictor 25 used with the assembly preferably has a generally cylindrical body 26 with a coaxial bore 41. As shown in FIG. 1, the cylindrical flow restrictor 25 is captured within the chamber by means of the retaining shoulder 37, the interior wall 35 of the cylindrical body 31 and the cap 27. Advantageously, the interior wall 35 conforms to the outer cylindrical wall 43 of the fluid restrictor 25 so that the interior wall 35 of the housing and the exterior wall 43 of the restrictor 25 form a fluid-tight seal.

As can readily be understood from the drawings, all fluid from the fluid flow channel must pass through the screen 29 and the coaxial bore 41 of the flow restrictor 25 before it can be discharged by the sprinkler head 13. The cap 27 includes a coaxial bore 45 which communicates with the bore 41 of the fluid restrictor 25, so that all fluid passing through the coaxial bore 41 of the fluid restrictor also passes through the bore 45 of the cap. Although the bore 41 in the fluid restrictor shown in the drawings is the same size as the bore 45 in the cap, it is desirable that the bore of the cap be at least as large as the bore of the fluid restrictor in order that the cap does not appreciably resist the flow of fluid after it is passed through the fluid restrictor.

The cap 27 includes a cylindrical body 47 which forms an exterior annular wall 49 having an outer diameter which conforms to the inner diameter of the interior wall 35 of the flow restrictor housing 23 so that the cap 27 fits snugly within the interior wall 35 of the housing. The height of the exterior wall 49 of the cap is such that when the cap 27 is fully inserted within the interior wall 35 of the housing, the cap 27 forces the restrictor 25 against the retaining shoulder 37 of the housing 23 so that the restrictor 25 is held in proper alignment within the chamber. Extending inward from the upstream end of the cap's body 47 is an annular lip 50. In order to further ensure that the restrictor 25 is properly aligned within the housing 23, an annular projection 51 extending upstream from, and having a smaller diameter than, the lip 50 is provided around the periphery of the bore 45. The annular projection 51 mates with a shallow cavity 53 on the flow restrictor 25 formed by a raised peripheral projection 55 and a flat annular interior surface 56 surrounding the restrictor's bore 41.

In order to more securely hold the cap 27 against the fluid restrictor 25, an outwardly extending annular flange 57 is provided at the downstream end of the cylindrical body 47 of the cap. As seen in FIG. 1, when the sprinkler head 13 is firmly threaded onto the exterior threads of the fitting 11, an interior shoulder 59 within the sprinkler head 13 clamps the flange 57 of the cap against the flange 33 of the housing, and the flange 33 of the housing against the raised cylindrical wall 17 of the fitting, thus capturing the restrictor in the housing 23 and holding the assembly at the mouth of the fluid flow channel.

Since many sprinkler heads incorporate a spray adjustment screw 61, as shown in FIG. 1, the cylindrical body 47 of the cap advantageously includes a clearance cavity formed by a cylindrical interior surface 63 and a flat annular interior surface 64 so that the adjustment screw 61 will not block the flow of fluid from the cap bore 45.

FIG. 3 shows an alternative embodiment 65 of the flow regulator assembly 10 of FIG. 1 inserted for use in a fitting 67 connected to a typical long lawn sprinkler head 68 or second fitting. As with the assembly of FIG. 1, the fitting and sprinkler head are shown for purposes of illustration only, as the alternative assembly is readily adapted to be held within the mouth of any one of a variety of fluid flow channels.

The alternative screened flow regulator assembly 65 includes a flow restrictor housing 69, a flow restrictor 71 and a cap 73. The flow restrictor housing 69 is identical to the housing 31 of FIG. 1, except that rather than a relatively short frusto-conical screen 29 extending radially inward from an annular retaining shoulder 37 at an angle of approximately 40°, the housing 69 includes an elongate screen 75 which tapers radially inward at an angle of approximately 20°. The outer surface of the screen 75 forms a shape resembling a series of seven coaxially stacked discs 77 of gradually decreasing diameter with a closed circular outer end 79. Surrounding the end of each of the discs closest to the body 81 of the housing 69 is a series of rectangular openings 83 through which fluid may flow. Between each of the openings 83 is a radially inward extending rib 82.

Likewise, as shown in FIGS. 3 and 4, the flow restrictor 71 and the cap 73 of the assembly 65 are virtually identical to the restrictor 25 and the cap 21 of the assembly 10 of FIG. 1, except that the raised annular projection 83 of the cap 73, the raised peripheral or axial projection 85 on the fluid flow restrictor 71 and the annular interior surface 87 of the restrictor 71 form an annular gap 89 surrounding the mouth of the bore 91 extending through the restrictor 71. As is apparent from FIGS. 4 and 5, this gap 89 can be formed by simply increasing the distance the raised annular peripheral projection 85 extends from the flat annular interior surface 87 surrounding the restrictor's bore 91, or by decreasing the thickness of the annular projection 83 surrounding the bore 93 extending through the cap 73. The gap 89 is desirable in that it provides the room for the elastomeric fluid flow restrictor 71 within the housing 69 to flex in response to the input pressure of fluid against the restrictor 71, thereby decreasing the diameter of the restrictor's bore 91.

FIG. 6 illustrates the significance of this gap for purposes of obtaining a constant rate of fluid flow through an assembly utilizing a 65 durometer elastomeric fluid flow restrictor with a 0.105 inch diameter bore. The dashed line illustrates the relationship between the gallons of fluid flow per minute given the pounds per square inch of input pressure wherein there is no gap between the raised annular projection around the periphery of the bore of the cap and the cylindrical body of the fluid flow restrictor. The solid line illustrates the relationship between the gallons per minute of fluid flow to pounds per square inch of input pressure for an assembly wherein a 0.035 inch annular space or gap is formed between the raised annular projection surrounding the bore of the cap and the flat annular interior surface of the fluid flow restrictor. The superiority of the assembly incorporating a gap between the cap and the fluid flow restrictor for purposes of obtaining a constant fluid flow rate over a wide range of pressures is clear. Without the gap, the assembly has a fluid flow rate of 0.6 gallons per minute at 20 pounds per square inch of input and a flow rate of 0.85 gallons per minute for an input pressure of 70 psi, an increase of over 41%. In contrast, the assembly incorporating an annular gap of 0.035 inch between the annular projection surrounding the bore of the cap and the flat annular interior surface of the fluid flow restrictor permits a flow rate of 0.7 gallons per minute at an input pressure of 20 psi, an a flow rate of 0.75 gallons per minute at an input pressure of 70 psi, a difference of only 7%.

The screened fluid flow regulator assembly thus provided can be installed in a wide variety of sprinkler systems by merely removing the existing screen and inserting the assembly into the mouth of the fluid flow channel. Once the assembly is installed in the system, adjustments in the volume rate of fluid flow can be made in discrete areas of the system by simply replacing the assembly with another assembly containing a flow restrictor having a larger or smaller restrictor bore. The use of the assembly of the present invention will enhance the ability of the operator to "fine-tune" his fluid delivery system, while minimizing the downtime of the system during system conversions. Furthermore, since the assembly design readily lends itself to injection molding techniques, the assemblies can be mass produced at a nominal per unit cost.

Although it is expected that the assembly including a flow restrictor will be replaced as a unit, it is possible to remove the assembly, insert a new restrictor in the assembly and replace the assembly unit. Likewise, if desired, the restrictor can be removed from the assembly and the restrictorless assembly can be inserted into the mouth of the fluid flow channel.

I claim:

1. A fluid flow regulator assembly adapted to be held by a pair of fittings within the mouth of a fluid flow channel, comprising:

an elastomeric, generally disc-shaped flow restrictor which controls the flow of fluid by permitting a controlled volumetric rate of fluid flow through a bore extending through said restrictor;

a molded, non-threaded housing for said flow restrictor, said housing including an interior wall partially forming a chamber on the downstream end of the housing in which said flow restrictor is removably insertable, an axially thin, flat outwardly extending flange surrounding said chamber on said downstream end clampable between said pair of fittings to hold said housing at said mouth of said fluid channel, structure on the upstream end of said housing for confining said restrictor within said chamber, said structure defining an opening communicating with said fluid flow channel; and a cap removably secured to the downstream end of said housing to capture said restrictor in said chamber and forming with said housing a replaceable assembly to be held by said fittings, said cap including a bore for communicating with said fluid flow channel, said cap and said restrictor cooperating to form a gap between the cap and a portion of said restrictor, said gap permitting said restrictor to flex in the downstream direction in response to the input pressure of fluid against said restrictor.

2. The assembly of claim 1, wherein said restrictor includes an axial peripheral projection which engages said cap, and said gap is formed between said cap and an axial interior surface of said restrictor radially inward from said projection.

3. The assembly of claim 1, wherein said cap includes an axially thin flange which engages said housing flange.

* * * * *